US011312132B2

(12) United States Patent
Mizutani et al.

(10) Patent No.: US 11,312,132 B2
(45) Date of Patent: Apr. 26, 2022

(54) HEAD DRIVING DEVICE AND IMAGE FORMING APPARATUS INCLUDING SAME

(71) Applicants: Tomohiro Mizutani, Kanagawa (JP); Katsuhiro Tobita, Ibaraki (JP); Toshihiro Tsukagoshi, Kanagawa (JP); Takatsugu Maeda, Kanagawa (JP)

(72) Inventors: Tomohiro Mizutani, Kanagawa (JP); Katsuhiro Tobita, Ibaraki (JP); Toshihiro Tsukagoshi, Kanagawa (JP); Takatsugu Maeda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/999,425

(22) Filed: Aug. 21, 2020

(65) Prior Publication Data

US 2021/0060937 A1 Mar. 4, 2021

(30) Foreign Application Priority Data

Aug. 30, 2019 (JP) ..... JP2019-158881

(51) Int. Cl.
*B41J 2/05* (2006.01)
*B41J 2/045* (2006.01)

(52) U.S. Cl.
CPC ..... *B41J 2/04588* (2013.01); *B41J 2/04586* (2013.01)

(58) Field of Classification Search
CPC .... B41J 2/0454; B41J 2/04581; B41J 2/2128; B41J 2/0459
See application file for complete search history.

(56) References Cited

U.S. PATENT DOCUMENTS

2003/0117454 A1* 6/2003 Junhua ..... B41J 2/2128 347/19
2012/0249638 A1* 10/2012 Takano ..... B41J 2/0454 347/10
2017/0165962 A1 6/2017 Mizutani et al.

FOREIGN PATENT DOCUMENTS

| | | |
|---|---|---|
| JP | 2013-000917 | 1/2013 |
| JP | 2015-214083 | 12/2015 |
| JP | 2016-083929 | 5/2016 |
| JP | 2016-155247 | 9/2016 |
| JP | 2017-109479 | 6/2017 |
| JP | 2017-170652 | 9/2017 |
| JP | 2017-222140 | 12/2017 |
| JP | 2019-098686 | 6/2019 |

* cited by examiner

*Primary Examiner* — Lam S Nguyen
(74) *Attorney, Agent, or Firm* — Duft & Bornsen, PC

(57) ABSTRACT

There is provided a head driving device for causing a head to discharge droplets. The device includes a drive circuit, a first drive waveform generation circuit, a second drive waveform generation circuit, and a correction circuit. The drive circuit is configured to drive the head based on a plurality of drive waveforms to discharge the droplets. The first drive waveform generation circuit configured to generate a first drive waveform of the plurality of drive waveforms. The second drive waveform generation circuit is configured to generate a second drive waveform of the plurality of drive waveforms. The correction circuit is configured to correct the first drive waveform and the second drive waveform with reference to an intermediate potential.

20 Claims, 9 Drawing Sheets

HEAD DRIVING DEVICE AND IMAGE FORMING APPARATUS INCLUDING SAME

CROSS-REFERENCE TO RELATED APPLICATION

This patent application is based on and claims priority pursuant to 35 U.S.C. § 119(a) to Japanese Patent Application No. 2019-158881, filed on Aug. 30, 2019, in the Japan Patent Office, the entire disclosure of which is hereby incorporated by reference herein.

BACKGROUND

Technical Field

Aspects of the present disclosure relate to a head driving device and an image forming apparatus including the head driving device.

Related Art

In order to discharge liquid droplets from nozzles, there is known a method of controlling discharge by transmitting a drive waveform.

For example, a plurality of drive waveforms are used to discharge three types of large, medium, and small ink droplets. A droplet discharge apparatus, for example, corrects the intermediate potential of a discharge drive waveform to lower the voltage. There is known a method of stabilizing the discharge characteristics of droplets in such a manner to precisely discharge droplets at high speed.

SUMMARY

In an aspect of the present disclosure, there is provided a head driving device for causing a head to discharge droplets. The device includes a drive circuit, a first drive waveform generation circuit, a second drive waveform generation circuit, and a correction circuit. The drive circuit is configured to drive the head based on a plurality of drive waveforms to discharge the droplets. The first drive waveform generation circuit configured to generate a first drive waveform of the plurality of drive waveforms. The second drive waveform generation circuit is configured to generate a second drive waveform of the plurality of drive waveforms. The correction circuit is configured to correct the first drive waveform and the second drive waveform with reference to an intermediate potential.

In another aspect of the present disclosure, there is provided a head driving device for causing a head to discharge droplets. The device includes a drive unit, a first drive waveform generation unit, a second drive waveform generation unit, and a correction unit. The drive unit is configured to drive the head based on a plurality of drive waveforms to discharge the droplets. The first drive waveform generation unit configured to generate a first drive waveform of the plurality of drive waveforms. The second drive waveform generation unit is configured to generate a second drive waveform of the plurality of drive waveforms. The correction unit is configured to correct the first drive waveform and the second drive waveform with reference to an intermediate potential.

In still another aspect of the present disclosure, there is provided an image forming apparatus including the head driving device according to any of the above-described aspects.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
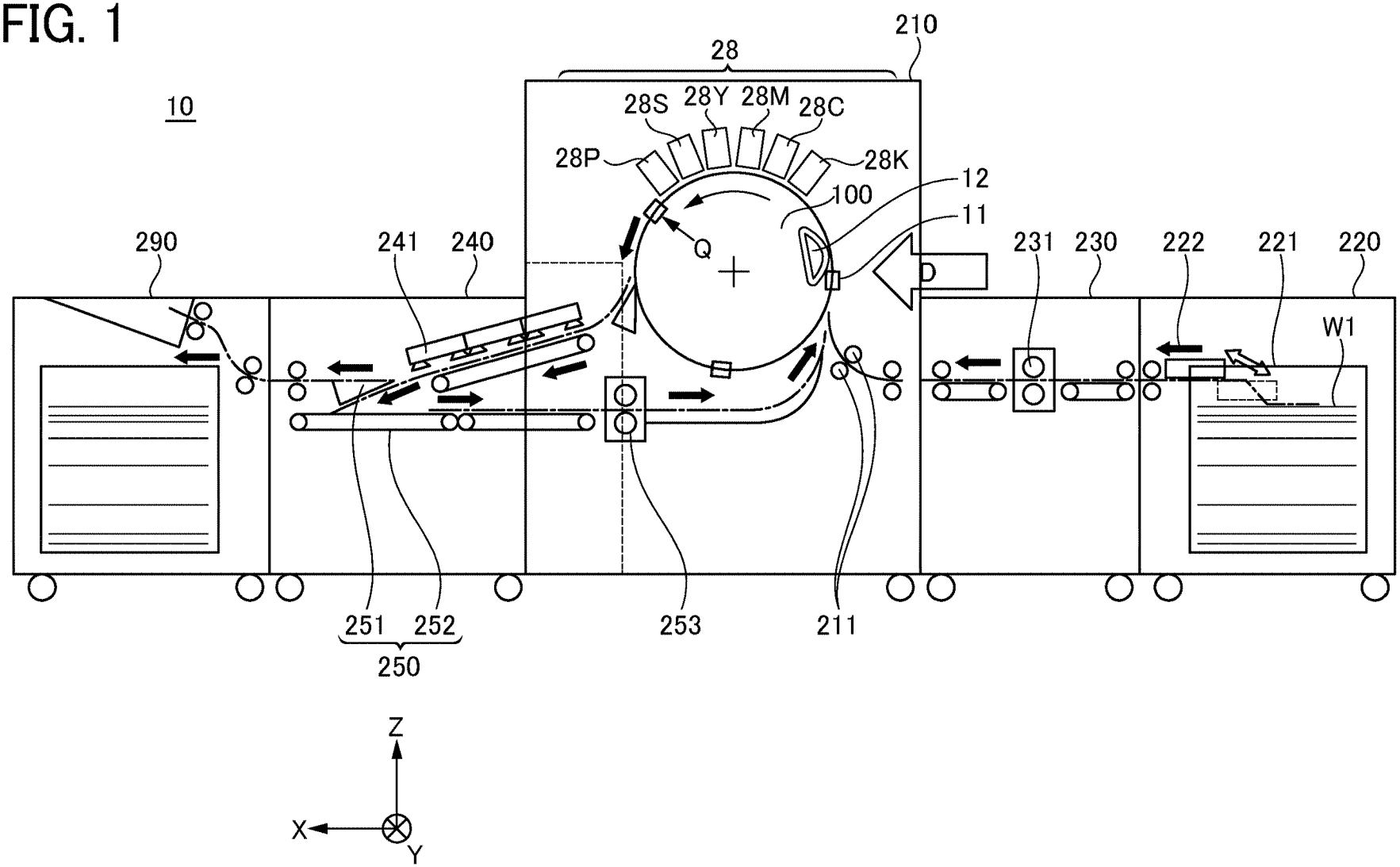
FIG. 1 is an illustration of an example of an image forming apparatus.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Hereinafter, optimum and minimum modes for carrying out the invention are described with reference to the drawings. In the drawings, the same reference codes are allocated to components or portions having the same configuration and redundant descriptions may be omitted. In addition, each of the illustrated specific examples is an example, and a configuration in which a configuration other than the illustrated configuration is further included may be employed.

Example of Image Forming Apparatus

FIG. 1 is a schematic cross-sectional view illustrating a configuration of an image forming apparatus. An image forming apparatus 10 includes, for example, an image forming device 210, a sheet feeder 220, a registration adjuster 230, a dryer 240, a reversing device 250, and a sheet ejector 290.

The sheet feeder 220 picks up a sheet W1, which is an example of a recording medium stacked in a sheet feed stack. For example, the sheet W1 is picked up by an air separator 221 or the like. After being picked up by the air separator 221 or the like, the sheet W1 is conveyed toward the image forming device 210.

When the sheet W1 fed by the sheet feeder 220 is conveyed to the registration adjuster 230, the inclination and the like of the sheet W1 are adjusted by the registration roller pair 231 and the like. Thereafter, the sheet W1 is conveyed from the registration adjuster 230 to the image forming device 210.

The image forming device 210 includes head modules 28K, 28C, 28M, 28Y, 28S, and 28P which are examples of a head driving device. Hereinafter, a description is given of an example in which the image forming device 210 includes the plurality of head modules 28K, 28C, 28M, 28Y, 28S, and 28P. For example, the head modules 28K, 28C, 28M, 28Y, 28S, and 28P discharge droplets of ink or the like to perform processing such as image formation. When color images are formed, head modules for different colors, such as head modules 28K, 28C, 28M, 28Y, 28S, and 28P, are prepared. Hereinafter, any head module among the head modules 28K, 28C, 28M, 28Y, 28S, and 28P is referred to as a "head module 28".

In the image forming device 210, the sheet W1 is conveyed by conveying rollers 211 and the like. A gripper 11 is installed on an outer surface of a drum 100. When the drum 100 rotates with the gripper 11 gripping the sheet W1, the sheet W1 is conveyed to a position where the head modules 28K, 28C, 28M, 28Y, 28S, and 28P face the drum 100.

The image forming device 210 discharges ink along the drum 100 having a cylindrical shape by an ink jet method to perform processing such as image formation. Thus, the head modules 28K, 28C, 28M, 28Y, 28S, and 28P are arranged radially at angles, for example, along the drum 100.

The image forming device 210 may include a dummy discharge receptacle 12 or the like. In a case where the head module 28 does not discharge ink to the sheet W1, that is, in a case where image formation is not performed on the recording medium, so-called dummy discharge or the like in which the dummy discharge receptacle 12 receives ink may be performed.

When an image is formed on the sheet W1 by the image forming device 210, the sheet W1 is conveyed to the drier 240.

The dryer 240 includes a drying unit 241 or the like. The drying unit 241 evaporates moisture of the sheet W1 being conveyed, to perform drying.

The dryer 240 may include the reversing device 250. For example, when performing so-called double-sided printing, the reversing device 250 reverses the sheet W1 by a reversing mechanism 251 or the like. The reversed sheet W1 is conveyed again to the image forming device 210 by a reversing conveyor 252. Inclination or the like of the conveyed sheet W1 may be corrected by a registration roller pair 253 or the like.

When the drying is completed by the drier 240, the sheet W1 is conveyed to the sheet ejector 290. Thus, the sheet W1 on which the image formation is completed is accumulated.

Example of Head Driving Device

Figure 2:
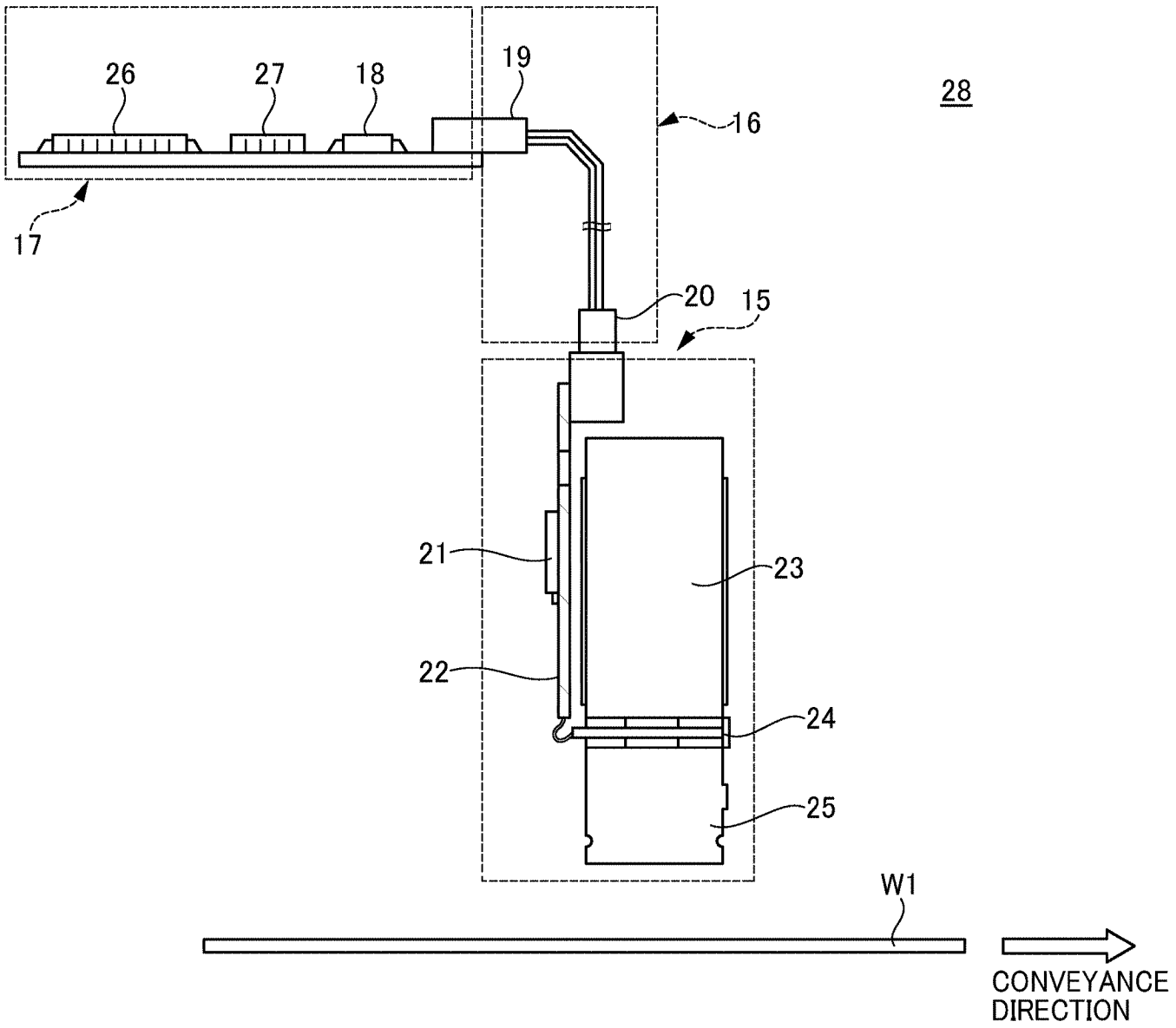
FIG. 2 is an illustration of an example of a head driving device.

FIG. 2 is an illustration of an example of the image forming apparatus. The head module 28 includes, for example, a drive control board 17, a recording head 15, and a cable 16.

The drive control board 17 includes, for example, a drive control circuit 26, a drive waveform generation circuit 27, and a storage device 18. The drive control board 17 may be configured to include hardware other than the drive control circuit 26, the drive waveform generation circuit 27, and the storage device 18.

The cable 16 electrically connects a drive control board connector 19 and a recording head connector 20. Therefore, the cable 16 performs communication between the drive control board 17 and a head board 22 of a recording head 15 by analog signals and digital signals.

The recording head 15 includes a residual vibration detection module 21, the head board 22, a head drive circuit board 24 that is an example of a drive unit, an in-head ink tank 23, a rigid plate 25, and the like.

In the line-scanning inkjet method, the recording head 15 has a line head configuration in which a plurality of recording heads 15 are arranged in a direction orthogonal to a conveyance direction (hereinafter, simply referred to as an "orthogonal direction") (a front direction and a depth direction in FIG. 2).

However, the image forming apparatus may not have a line head configuration. For example, the image forming apparatus may be configured to move one or more recording heads 15 in the orthogonal direction and convey the sheet W1 in the conveyance direction. Thus, the image forming apparatus may be a serial scanning printer, a line head printer, or other configurations.

Example of Configuration of Recording Head

Figure 3:
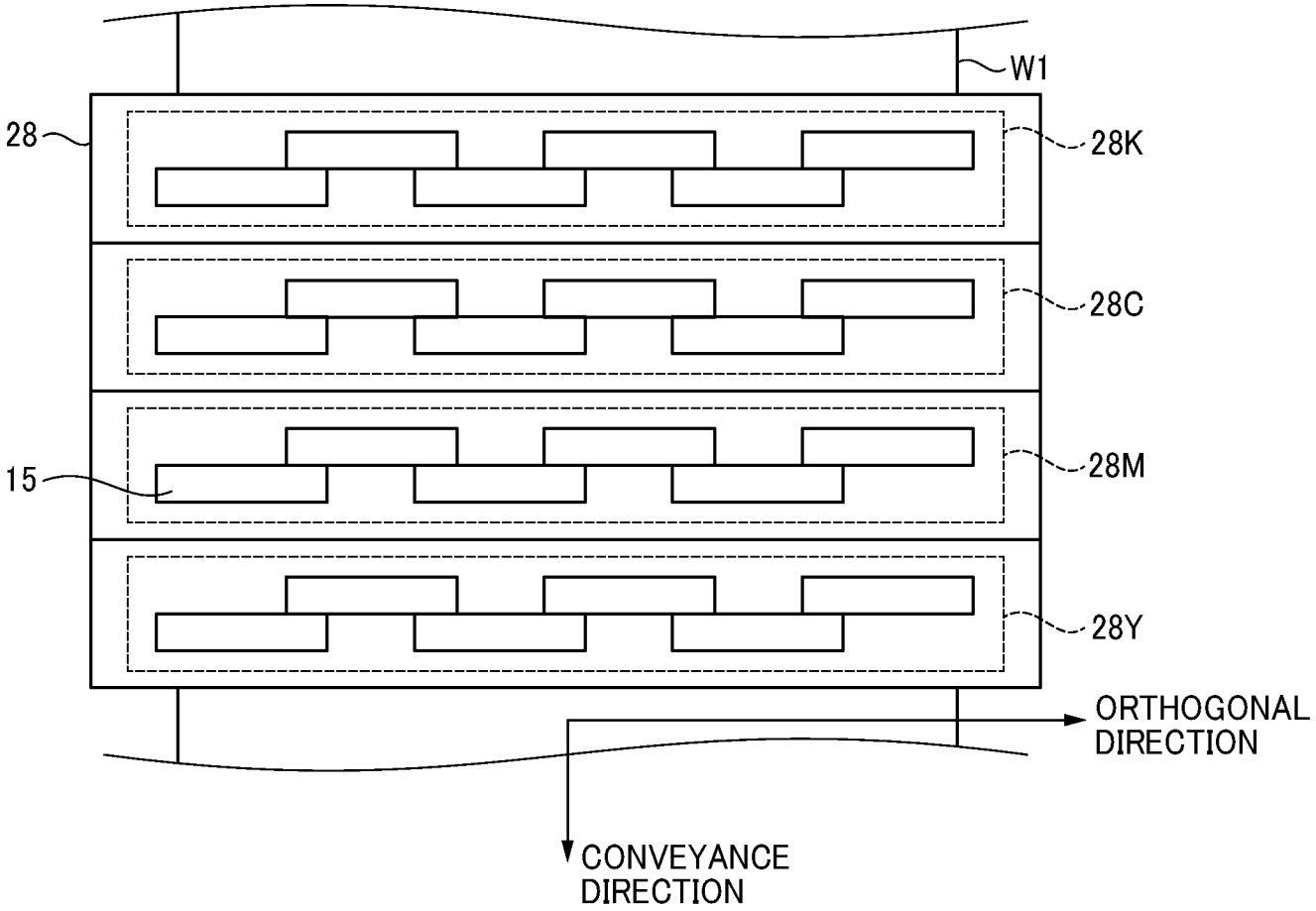
FIG. 3 is an illustration of an example of a head configuration.

FIG. 3 is an illustration of an example of the head configuration. For example, the head modules 28 include the head module 28K for black, the head module 28C for cyan, the head module 28M for magenta, and the head module 28Y for yellow.

The head module 28K for black includes a head array for black that discharges black ink.

The head module 28C for cyan includes a head array for cyan that discharges cyan ink.

The head module 28M for magenta includes a head array for magenta that discharges magenta ink.

The head module 28Y for yellow includes a head array for yellow that discharges yellow ink.

The head arrays for the respective colors are arranged, for example, in the orthogonal direction as illustrated in FIG. 3. When the recording heads 15 are arrayed in this manner, a wide range can be printed.

Figure 4:
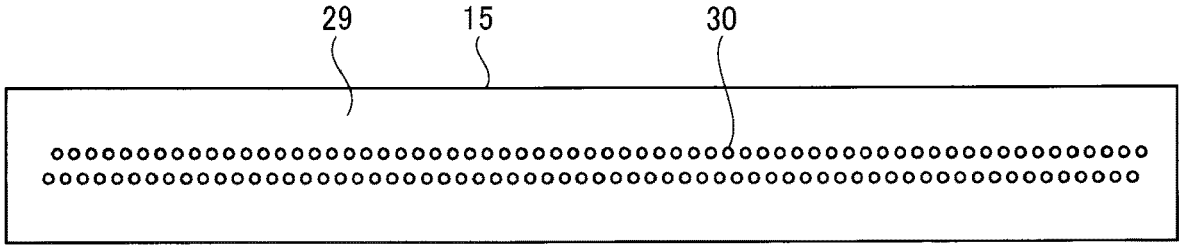
FIG. 4 is an illustration of an example of a recording head.

FIG. 4 is an illustration of an example of the recording head. FIG. 4 is an enlarged bottom view of the recording head.

A plurality of printing nozzles 30 are arranged in a staggered manner on a nozzle surface 29 which is a bottom surface of the recording head 15. In this way, the printing nozzles 30 are arranged in a staggered manner to achieve high-resolution image formation.

Figure 5:
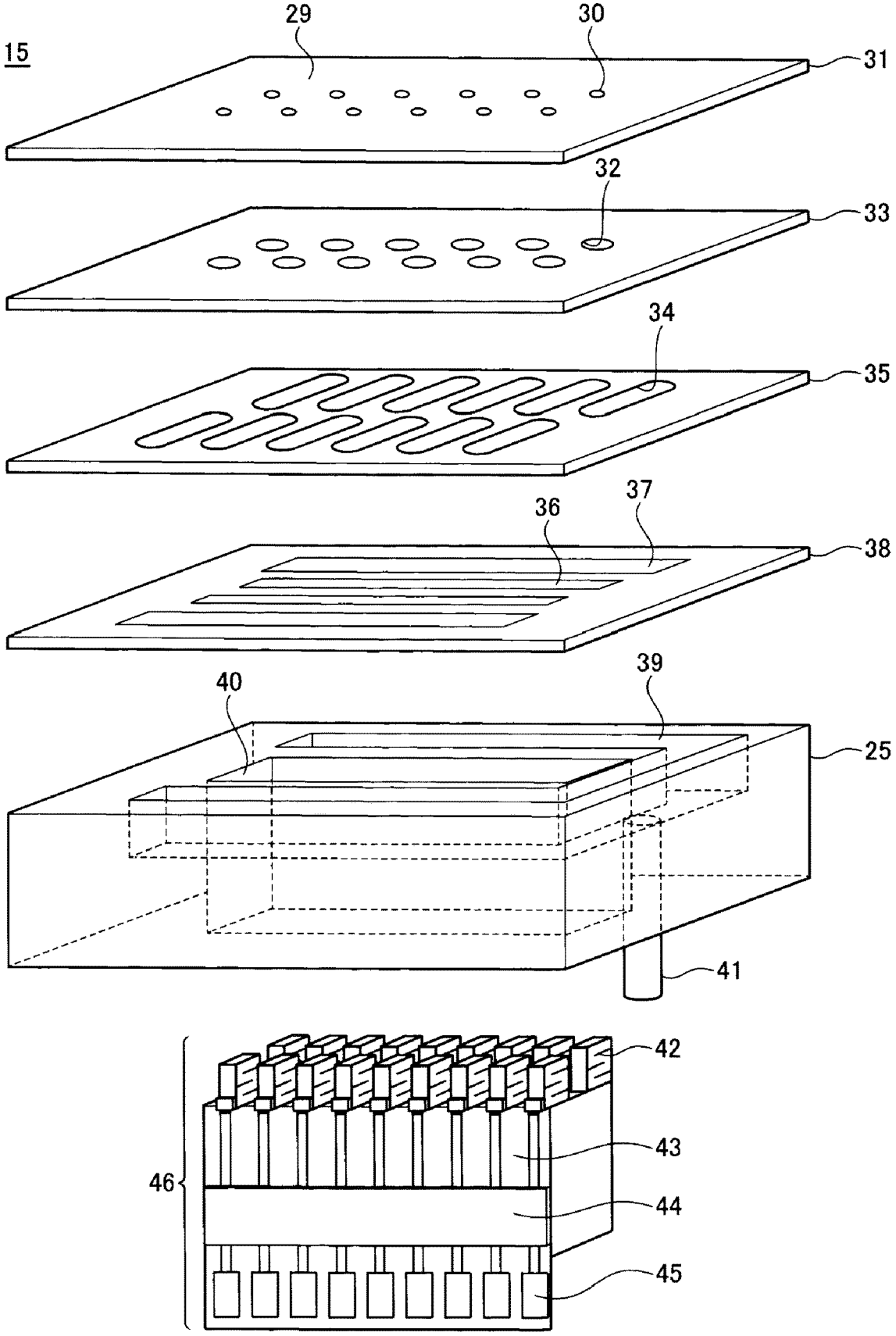
FIG. 5 is an illustration of an example of a head configuration.

FIG. 5 is an illustration of an example of the configuration of the recording head.

The recording head 15 includes a nozzle plate 31, a pressure chamber plate 33, a restrictor plate 35, a diaphragm plate 38, the rigid plate 25, and a piezoelectric element group 46.

The printing nozzles 30 are arranged in a staggered manner on the nozzle plate 31.

Individual pressure chambers 32 corresponding to the printing nozzles 30 are formed in the pressure chamber plate 33.

In the restrictor plate 35, restrictors 34 and the like are formed to communicate a common ink channel 39 with the individual pressure chambers 32 to control the ink flow rate to the individual pressure chambers 32.

The diaphragm plate 38 includes diaphragms 36, filters 37, and the like.

When the nozzle plate 31, the pressure chamber plate 33, the restrictor plate 35, and the diaphragm plate 38 are sequentially stacked, positioned, and joined, a channel plate is formed.

The channel plate is joined to the rigid plate 25, and the filters 37 are opposed to openings of the common ink channel 39.

An upper opening end of an ink introduction pipe 41 is connected to the common ink channel 39 of the rigid plate 25.

A lower opening end of the ink introduction pipe 41 is connected to an ink tank filled with ink.

A piezoelectric element drive circuit 44 is mounted on a piezoelectric element support base 43.

The piezoelectric element group 46 has a configuration in which a plurality of piezoelectric elements 42 are arranged. The piezoelectric element group 46 is inserted into the opening 40 of the rigid plate 25.

Free ends of the piezoelectric elements 42 are bonded and fixed to the diaphragms 36 to form the recording head 15.

In the example illustrated in FIG. 5, factors such as the nozzles, the pressure chambers, and the restrictors are reduced for simplification. Therefore, the nozzles, the pressure chambers, the restrictors, and the like may be configured to be larger in number.

Example of Configuration of Circuit

Figure 6:
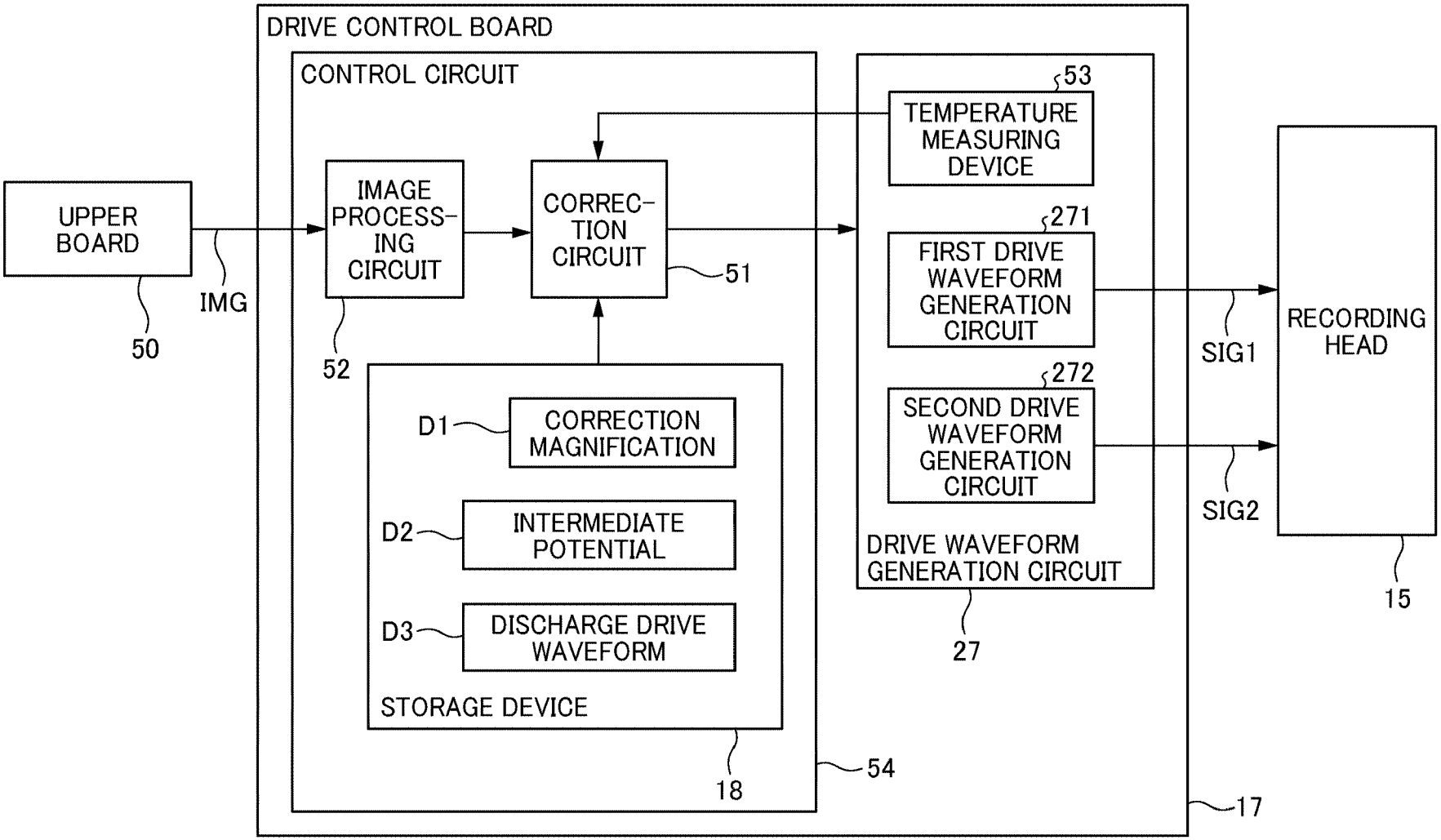
FIG. 6 is a diagram illustrating an example of a circuit configuration of the head driving device.

FIG. 6 is a diagram illustrating an example of the circuit configuration of the head driving device. The drive control board 17 includes a control circuit 54 and the drive waveform generation circuit 27.

Image data IMG and the like are transmitted from an upper board 50 and the like to the control circuit 54. The image data IMG may be subjected to image processing by an image processing circuit 52 or the like. The control circuit 54 generates a timing control signal, drive waveform data, and the like based on the image data IMG.

The timing control signal is transmitted to the recording head 15 by serial communication or the like. In the recording head 15, a signal transmitted by serial communication is deserialized.

The drive waveform generation circuit 27 performs digital-to-analog (D/A) conversion, voltage amplification, current amplification, and the like on the drive waveform data.

The drive waveform generation circuit 271 has a configuration of generating a plurality of drive waveforms, such as a first drive waveform generation circuit 271 that is an example of a first drive waveform generation unit and a second drive waveform generation circuit 272 that is an example of a second drive waveform generation unit. Hereinafter, a case where two systems of drive waveforms are used is described, but three or more systems of drive waveforms may be used.

For example, the first drive waveform generation circuit 271 generates a drive waveform for performing so-called fine driving in which vibration is performed to such an extent that liquid droplets are not discharged. On the other hand, the second drive waveform generation circuit 272 generates a drive waveform used for discharging a large droplet having a large liquid amount and drive waveforms used for discharging a medium droplet and a small droplet having liquid amounts smaller than the liquid amount of the large droplet. However, the plurality of drive waveforms may not be divided into the fine driving and the other driving. That is, as long as a plurality of types of drive waveforms may be generated by different circuits, the way of dividing the drive waveforms is not limited.

Hereinafter, among the plurality of drive waveforms generated by the drive waveform generation circuit 27, the drive waveform generated by the first drive waveform generation circuit 271 is referred to as a "first drive waveform". A signal indicating the first drive waveform is referred to as a "first drive signal SIG1". Among the plurality of drive waveforms generated by the drive waveform generation circuit 27, the drive waveform generated by the second drive waveform generation circuit 272 is referred to as a "second drive waveform". A signal indicating the second drive waveform is referred to as a "second drive signal SIG2".

The first drive waveform generation circuit 271 and the second drive waveform generation circuit 272 are switched by an intermediate potential.

The intermediate potential is a potential serving as a reference of the first drive signal SIG1 and the second drive signal SIG2. For example, the intermediate potential is a potential at an initial stage and a final stage. Therefore, when the circuit is switched, the signal of the drive waveform first becomes the value of the intermediate potential. That is, at the switching timing of the circuit, the first drive waveform and the second drive waveform have the intermediate potential.

The correction circuit 51, which is an example of a correction unit, corrects the voltage and the like. For example, the correction circuit 51 performs correction based on the temperature or the like measured by a temperature measurement device 53. The correction circuit 51 corrects the first drive signal SIG1, the second drive signal SIG2, and the like.

The correction is performed based on, for example, correction data input to the storage device 18, which is an example of a storage device. For example, when the correction is performed based on the temperature, the correction data includes a correction magnification D1, an intermediate potential D2, a discharge drive waveform D3, and the like that are stored per temperature. Therefore, the correction magnification D1, the intermediate potential D2, and the discharge drive waveform D3 are read out in accordance with the temperature measured by the temperature measuring device 53 and used for correction.

The correction may be performed using a parameter other than the temperature. For example, the correction may be performed based on individual differences of the nozzles. In addition, for example, a sensor other than a temperature measuring sensor may be provided to perform correction using another parameter measured by the sensor.

Example of Correction

Hereinafter, a description is given of an example of a drive waveform having a state as described below before correction.

Figure 7:
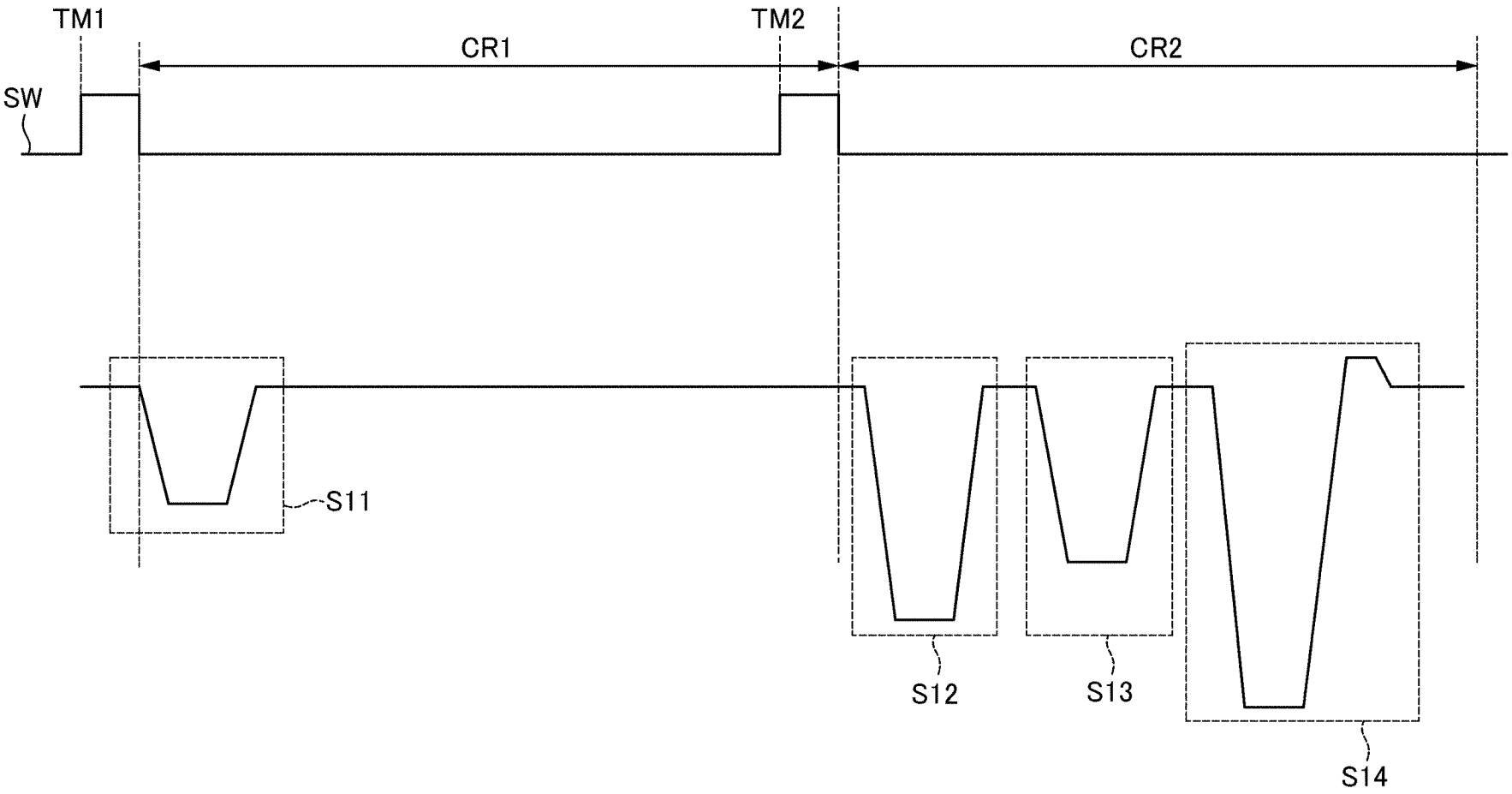
FIG. 7 is a diagram illustrating an example of a drive waveform before correction is performed.

FIG. 7 is a diagram illustrating an example of a drive waveform before correction is performed.

The switching signal SW is a signal for switching between the first drive waveform generation circuit 271 and the second drive waveform generation circuit 272. In the following example, the switching signal SW is asserted and switched so that the first drive waveform generation circuit 271 operates at the first switching timing TM1. The switching signal SW is asserted and switched so that the second drive waveform generation circuit 272 operates at the second switching timing TM2. Therefore, in an operation period CR1 of the first drive waveform generation circuit 271, the signal generated by the first drive waveform generation circuit 271, that is, the first drive signal SIG1 is used. On the other hand, in an operation period CR2 of the second drive waveform generation circuit 272, the signal generated by the second drive waveform generation circuit 272, that is, the second drive signal SIG2 is used.

A fine drive signal S11 is an example of a drive signal for performing fine driving.

A large-droplet drive signal S12 is an example of a drive signal for discharging a large droplet.

A medium-droplet drive signal S13 is an example of a drive signal for discharging a medium droplet.

A small-droplet drive signal S14 is an example of a drive signal for discharging a small droplet.

As described above, this example is an example of the two-system configuration in which the fine drive signal S11 is generated by the first drive waveform generation circuit 271, and the large-droplet drive signal S12, the medium-droplet drive signal S13, and the small-droplet drive signal S14 are generated by the second drive waveform generation circuit 272.

Hereinafter, a description is given of an example in which the correction data has the following values.

In the correction magnification D1, the correction magnification for the first drive waveform generation circuit 271 (hereinafter referred to as "first correction magnification") is "20%", and the correction magnification for the second drive waveform generation circuit 272 (hereinafter referred to as "second correction magnification") is "10%".

The correction magnification may be a value set in advance or a value calculated based on a measured parameter or the like.

It is assumed that the intermediate potential D2 is the same reference point in the first drive signal SIG1 and the second drive signal SIG2 and has a value of "110".

For the discharge drive waveform D3, drive waveform values are input in the order of "110"→"80"→"75"→"85"→"100"→"130"→"155"→"110" for the first drive waveform generation circuit 271.

For the discharge drive waveform D3, drive waveform values are input in the order of "110"→"70"→"64"→"50"→"65"→"80"→"125"→"110" for the second drive waveform generation circuit 272.

Figure 8:
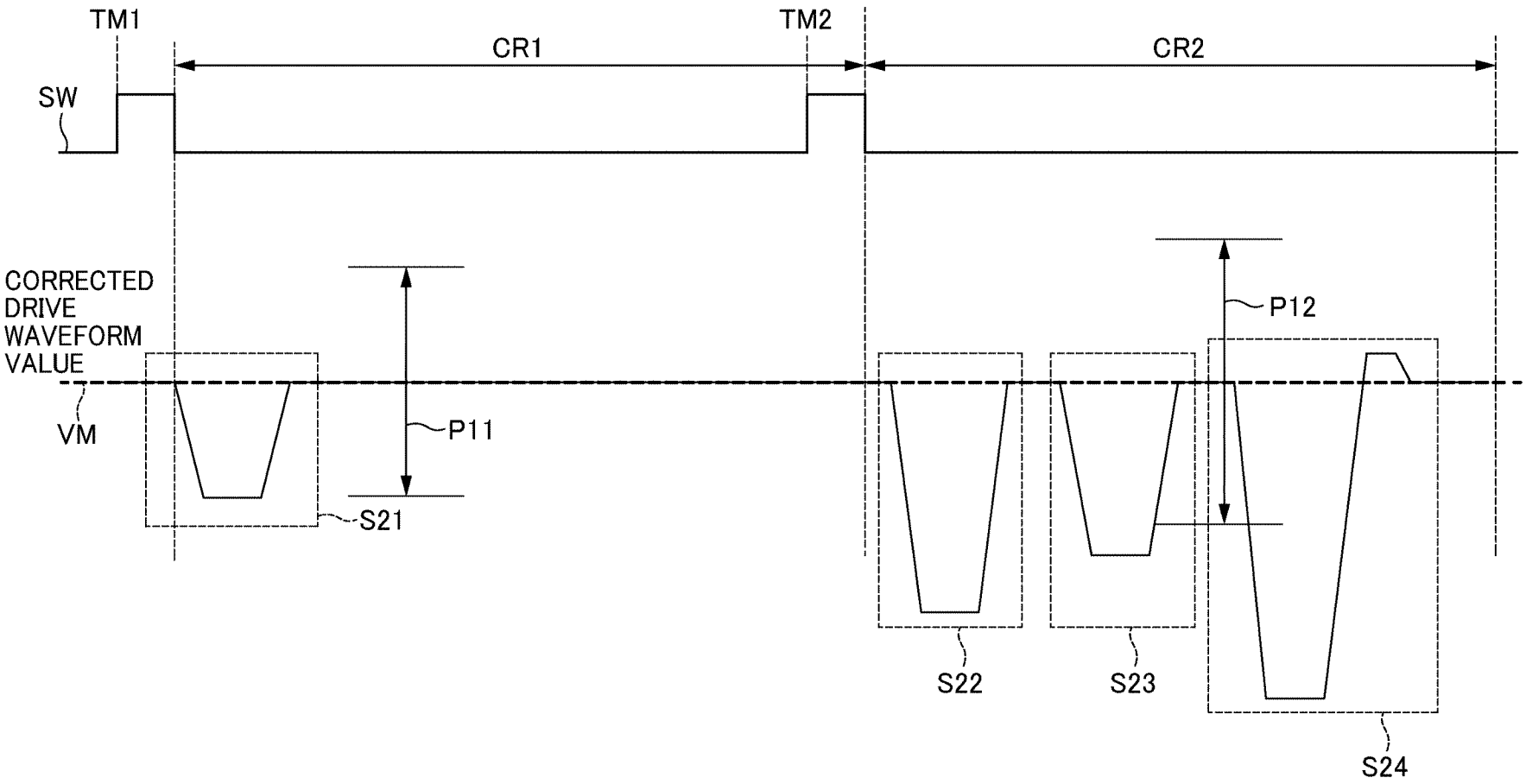
FIG. 8 is a diagram illustrating an example of correction based on an intermediate potential.

FIG. 8 is a diagram illustrating an example of correction based on an intermediate potential. For example, the image forming apparatus 10 corrects both the first drive signal SIG1 and the second drive signal SIG2 with reference to a reference (hereinafter, simply referred to as an "intermediate potential VM") based on the intermediate potential. The correction is performed by multiplying a drive waveform value by a first correction coefficient P11 and a second correction coefficient P12 determined for each drive waveform based on the value of the correction magnification input to the storage device 18.

For example, when the first correction magnification is "20%", a drive waveform value higher than the intermediate potential VM of "110" is corrected by multiplying the drive waveform value by the first correction coefficient P11 of "1.0+20%=1.2". On the other hand, the drive waveform value lower than the intermediate potential VM of "110" is corrected by multiplying the drive waveform value by the first correction coefficient P11 of "1.0−20%=0.8".

When the drive waveform value and the intermediate potential have the same value, the correction coefficient is preferably set to "1.0". When the correction coefficient is set to "1.0" in this manner, the drive waveform value having the same value as the intermediate potential is maintained at the value before the correction even after the correction. In other words, the drive waveform value that is the same value as the intermediate potential can be maintained at the same value as if no correction is performed. As described above, when the intermediate potential is maintained without correction, a potential difference is less likely to occur due to switching of the circuit.

When the drive waveform value for the first drive signal is corrected based on the above conditions, the following correction result is obtained.

"110": 110×correction coefficient of 1.0=110
"80": 80×correction coefficient of 0.8=64
"75": 75×correction coefficient of 0.8=60
"85": 85×correction coefficient of 0.8=68
"100": 100×correction coefficient of 0.8=80
"130": 130×correction coefficient of 1.2=156
"155": 155×correction coefficient of 1.2=186
"110": 110×correction coefficient of 1.0=110

In this example, the potential at each of the initial stage and the final stage, which is "110" in the above-described correction result, is the intermediate potential and the initial stage and the final stage are timings for switching the circuit.

When the second correction magnification is "10%", a drive waveform value higher than the intermediate potential VM of 110 is corrected by multiplying the drive waveform value by the second correction coefficient P12 of "1.0+10%=1.1". On the other hand, a drive waveform value lower than the intermediate potential VM of "110" is corrected by multiplying the drive waveform value by the second correction coefficient P12 of "1.0−10%=0.9". Similar to the correction of the first drive signal, when the drive waveform value and the intermediate potential have the same value, the correction coefficient is set to "1.0".

When the drive waveform value for the second drive signal is corrected based on the above conditions, the following correction result is obtained.

"110": 110×correction coefficient of 1.0=110
"70": 70×correction coefficient of 0.9=63
"64": 64×correction coefficient of 0.9=57.6≈58
"50": 50×correction coefficient of 0.9=45
"65": 65×correction coefficient of 0.9=58.5≈59
"80": 80×correction coefficient of 0.9=72
"125": 125×correction coefficient of 1.1=137.5≈138
"110": 110×correction coefficient of 1.0=110

As in the case of the first drive signal, in this example, the potential at each of the initial stage and the final stage, which is "110" in the above-described correction result, is the intermediate potential and the initial stage and the final stage are timings for switching the circuit.

By such correction, a corrected fine drive signal S21, a corrected large-droplet drive signal S22, a corrected medium-droplet drive signal S23, a corrected small-droplet drive signal S24, and the like are generated.

As described above, it is preferable that the correction coefficient is determined based on whether the drive waveform value to be corrected is positive, negative, or the same with respect to the intermediate potential VM. When the correction is performed based on the intermediate potential VM in this manner, a potential difference is less likely to occur at the timing of switching even in a case where a plurality of drive waveforms are used. On the other hand, when a potential difference occurs, an abnormality such as droplet discharge based on the potential difference is likely to occur. Therefore, the correction performed based on the intermediate potential VM can reduce the abnormality such as droplet discharge based on the potential difference.

Such a configuration can also set different correction magnifications and the like for a plurality of circuits having different systems. Circuits may have variations depending on differences in element or harness length. Therefore, if different correction magnifications or the like can be set for circuits, variations in the circuits can be reduced by correction. Thus, reducing the variations can reduce an abnormality such as droplet discharge based on the potential difference.

Comparative Example

Figure 9:
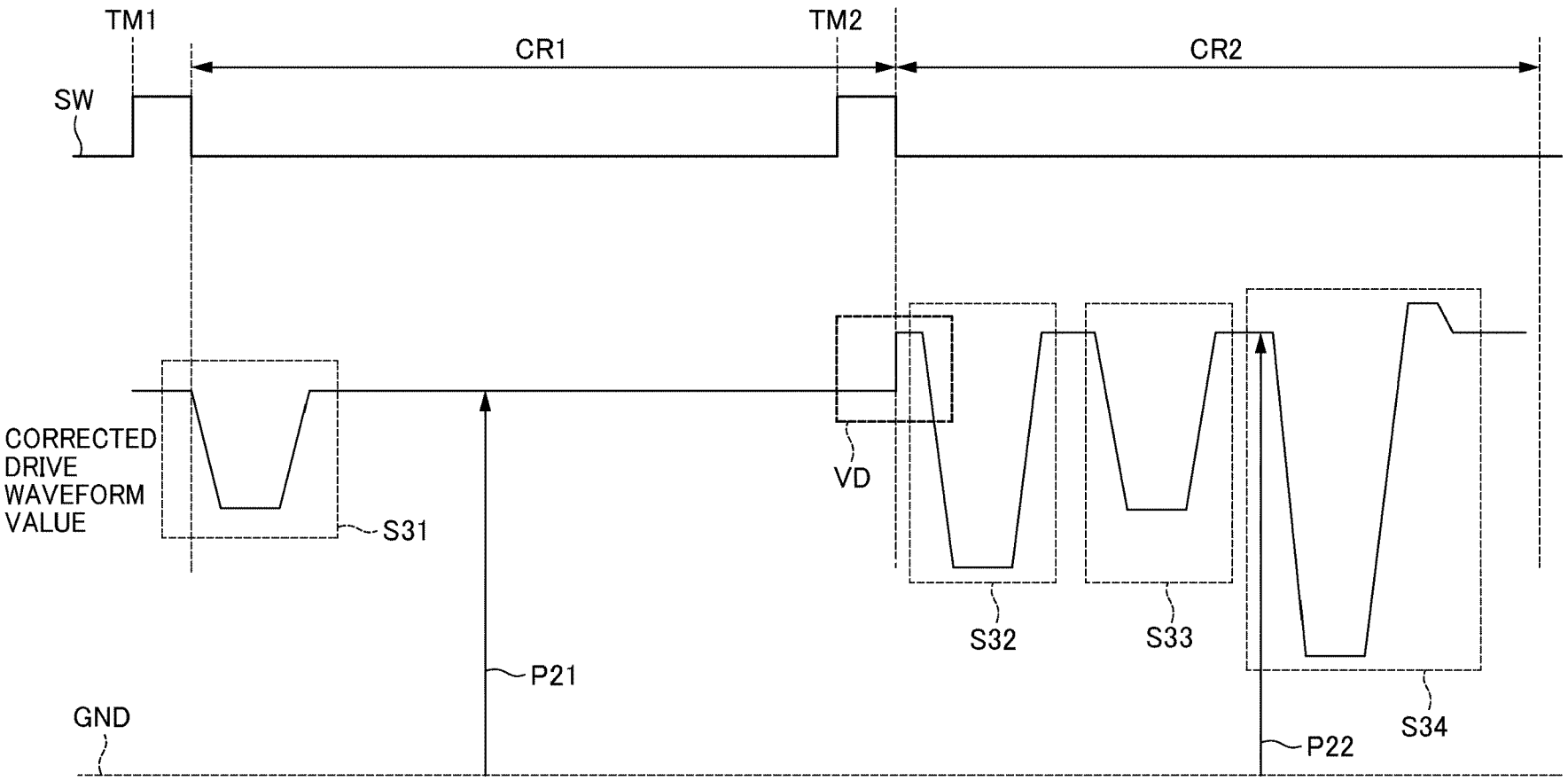
FIG. 9 is a diagram illustrating a comparative example.

FIG. 9 is a diagram illustrating a comparative example. The comparative example is different from the example of FIG. 8 in that the correction is performed with reference to the ground GND.

Hereinafter, it is assumed that the same values of the correction magnification, the intermediate potential, and the waveform value as those in FIG. 8 are used.

In the case of the comparative example, first, a first drive waveform value is uniformly multiplied by "1.2", which is a first comparison correction coefficient P21, by the correction, and the following values are obtained.

"110": 110×correction coefficient of 1.2=132
"80": 80×correction coefficient of 1.2=96
"75": 75×correction coefficient of 1.2=90
"85": 85×correction coefficient of 1.2=102
"100": 100×correction coefficient of 1.2=120
"130": 130×correction coefficient of 1.2=156
"155": 155×correction coefficient of 1.2=186
"110": 110×correction coefficient of 1.2=132

Next, in the case of the comparative example, the second drive waveform value is uniformly multiplied by "1.1", which is a second comparison correction coefficient P22, by the correction, and thus the following values are obtained.

"110": 110×correction coefficient of 1.1=121
"70": 70×correction coefficient of 1.1=77
"64": 64×correction coefficient of 1.1=70.4 70
"50": 50×correction coefficient of 1.1=55
"65": 65×correction coefficient of 1.1=71.5≈72
"80": 80×correction coefficient of 1.1=88
"125": 125×correction coefficient of 1.1=137.5≈138
"110": 110×correction coefficient of 1.1=121

By such correction, a comparison fine drive signal S31, a comparison large-droplet drive signal S32, a comparison medium-droplet drive signal S33, a comparison small-droplet drive signal S34, and the like are generated.

In the comparative example, when the correction is performed, the intermediate potential VM becomes different values such as "132" and "121" after the correction even if the intermediate potential VM has the same value. Such a correction causes a potential difference VD. That is, when the circuit is switched, an abnormality such as droplet discharge may occur due to the potential difference VD.

Other Embodiment

The number of each device described above is not limited to one. That is, each device may be configured by a plurality of devices.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

The invention claimed is:

1. A head driving device for causing a head to discharge droplets, the device comprising:

a drive circuit configured to drive the head based on a plurality of drive waveforms;

a first drive waveform generation circuit configured to generate a first drive signal indicating a first drive waveform of the plurality of drive waveforms;

a second drive waveform generation circuit configured to generate a second drive signal indicating a second drive waveform of the plurality of drive waveforms;

a storage device configured to store a correction magnification for the first drive waveform generation circuit, a correction magnification for the second drive waveform generation circuit, an intermediate potential, first drive waveform values for the first drive waveform, and second drive waveform values for the second drive waveform; and a correction circuit configured to correct the first drive signal and the second drive signal with reference to the intermediate potential;

wherein the first drive waveform generation circuit and the second drive waveform generation circuit are switched based on a switching signal to provide the first drive signal or the second drive signal to the head during an operation period;

wherein the correction circuit is configured to:

determine, based on the correction magnification for the first drive waveform generation circuit, a first correction coefficient for the first drive waveform values higher than the intermediate potential, and a second correction coefficient for the first drive waveform values lower than the intermediate potential;

multiply the first drive waveform values higher than the intermediate potential with the first correction coefficient; and multiply the first drive waveform values lower than the intermediate potential with the second correction coefficient.

2. The head driving device according to claim 1, wherein the correction circuit is configured to:

set a third correction coefficient equal to 1.0 for the first drive waveform values that are the same as the intermediate potential; and multiply the first drive waveform values that are the same as the intermediate potential with the third correction coefficient.

3. The head driving device according to claim 2, wherein the correction circuit is configured to:

determine, based on the correction magnification for the second drive waveform generation circuit, a fourth correction coefficient for the second drive waveform values higher than the intermediate potential, and a fifth correction coefficient for the second drive waveform values lower than the intermediate potential;

multiply the second drive waveform values higher than the intermediate potential with the fourth correction coefficient; and multiply the second drive waveform values lower than the intermediate potential with the fifth correction coefficient.

4. The head driving device according to claim 3, wherein the correction circuit is configured to:

set a sixth correction coefficient equal to 1.0 for the second drive waveform values that are the same as the intermediate potential; and multiply the second drive waveform values that are the same as the intermediate potential with the sixth correction coefficient.

5. The head driving device according to claim 1, wherein the correction circuit is configured to perform correction based on temperature, and wherein the storage device is configured to store the correction magnification for the first drive waveform generation circuit, the correction magnification for the second drive waveform generation circuit, the intermediate potential, the first drive waveform values for the first drive waveform, and the second drive waveform values for the second drive waveform per temperature.

6. The head driving device according to claim 1, wherein at a time of switching between the first drive waveform generation circuit and the second drive waveform generation circuit, the first drive waveform and the second drive waveform have the intermediate potential.

7. An image forming apparatus comprising the head driving device according to claim 1.

8. The head driving device according to claim 1, wherein the first drive waveform performs fine driving of the head so that droplets are not discharged, and the second drive waveform is used for discharging droplets.

9. The head driving device according to claim 8, wherein the second drive waveform comprises a drive waveform used for discharging a large droplet, a drive waveform used for discharging a medium droplet, and a drive waveform used for discharging a small droplet.

10. The head driving device according to claim 1, wherein:

the correction magnification for the first drive waveform generation circuit and the correction magnification for the second drive waveform generation circuit are set in advance.

11. The head driving device according to claim 1, wherein:

the correction magnification for the first drive waveform generation circuit and the correction magnification for the second drive waveform generation circuit are calculated based on a measured parameter.

12. A head driving device for causing a head to discharge droplets, the device comprising:

a drive unit configured to drive the head based on a plurality of drive waveforms;

a first drive waveform generation unit configured to generate a first drive signal indicating a first drive waveform of the plurality of drive waveforms;

a second drive waveform generation unit configured to generate a second drive signal indicating a second drive waveform of the plurality of drive waveforms;

a storage device configured to store a correction magnification for the first drive waveform generation unit, a correction magnification for the second drive waveform generation unit, an intermediate potential, first drive waveform values for the first drive waveform, and second drive waveform values for the second drive waveform; and a correction unit configured to correct the first drive signal and the second drive signal with reference to the intermediate potential;

wherein the first drive waveform generation unit and the second drive waveform generation unit are switched based on a switching signal to provide the first drive signal or the second drive signal to the head during an operation period;

wherein the correction unit is configured to:

determine, based on the correction magnification for the first drive waveform generation unit, a first correction coefficient for the first drive waveform values higher than the intermediate potential, and a second correction coefficient for the first drive waveform values lower than the intermediate potential;

multiply the first drive waveform values higher than the intermediate potential with the first correction coefficient; and multiply the first drive waveform values lower than the intermediate potential with the second correction coefficient.

13. The head driving device according to claim 12, wherein the correction unit is configured to:

set a third correction coefficient equal to 1.0 for the first drive waveform values that are the same as the intermediate potential; and multiply the first drive waveform values that are the same as the intermediate potential with the third correction coefficient.

14. The head driving device according to claim 13, wherein the correction unit is configured to:

determine, based on the correction magnification for the second drive waveform generation unit, a fourth correction coefficient for the second drive waveform values higher than the intermediate potential, and a fifth correction coefficient for the second drive waveform values lower than the intermediate potential;

multiply the second drive waveform values higher than the intermediate potential with the fourth correction coefficient; and multiply the second drive waveform values lower than the intermediate potential with the fifth correction coefficient.

15. The head driving device according to claim 14, wherein the correction unit is configured to:

set a sixth correction coefficient equal to 1.0 for the second drive waveform values that are the same as the intermediate potential; and multiply the second drive waveform values that are the same as the intermediate potential with the sixth correction coefficient.

16. The head driving device according to claim 12, wherein the correction unit is configured to perform correction based on temperature, and wherein the storage device is configured to store the correction magnification for the first drive waveform generation unit, the correction magnification for the second drive waveform generation unit, the intermediate potential, the first drive waveform values for the first drive waveform, and the second drive waveform values for the second drive waveform per temperature.

17. The head driving device according to claim 12, wherein at a time of switching between the first drive waveform generation unit and the second drive waveform generation unit, the first drive waveform and the second drive waveform have the intermediate potential.

18. An image forming apparatus comprising the head driving device according to claim 12.

19. The head driving device according to claim 12, wherein:

the correction magnification for the first drive waveform generation unit and the correction magnification for the second drive waveform generation unit are set in advance.

20. The head driving device according to claim 12, wherein:

the correction magnification for the first drive waveform generation unit and the correction magnification for the second drive waveform generation unit are calculated based on a measured parameter.

* * * * *